US005287625A

United States Patent [19]

Herron

[11] Patent Number: 5,287,625

[45] Date of Patent: Feb. 22, 1994

[54] SANDPAPER CUTTING GUIDE

[76] Inventor: John R. Herron, 4318 Country View Dr., Floyds Knobs, Ind. 47119

[21] Appl. No.: 27,659

[22] Filed: Mar. 8, 1993

[51] Int. Cl.[5] ..... B26B 29/02; B25B 5/14

[52] U.S. Cl. ..... 30/289; 269/265

[58] Field of Search ..... 30/2, 273, 282, 286, 30/288, 289; 33/32.1, 32.3, 32.7, 41.5; 269/265

[56] References Cited

U.S. PATENT DOCUMENTS

| | | | |
|---|---|---|---|
| 2,796,675 | 6/1957 | Schwenk et al. | 33/32.3 |
| 2,925,110 | 2/1960 | Bayers | 30/289 |
| 4,045,266 | 8/1977 | Hewitt, Jr. | 269/295 |
| 4,100,676 | 7/1978 | Ferguson | 269/295 |
| 4,505,039 | 3/1985 | Donovan | 30/289 |
| 4,574,492 | 3/1986 | Miller | 30/289 |

*Primary Examiner*—Richard K. Seidel

*Assistant Examiner*—Paul M. Heyrana

*Attorney, Agent, or Firm*—Roger M. Rickert

[57] ABSTRACT

An improved sandpaper cutting guide is disclosed having a series of recesses to receive different sized pieces of sandpaper. The longer side of a standard sized sheet of sandpaper is placed in one of the slots for cutting the sheet in half or the end of the standard sized sheet may be placed in another slot for cutting a one-third sheet piece. A cutting tool is inserted through a slit in the guide and drawn across the guide to cut a selected one of several smaller, also standard, piece sizes from the sheet. The same slit guides the cutting tool for all sizes with size being determined by the recess into which the sheet is placed. Access openings are provided to aid in removal of the cut piece from the guide. Preferably, recesses are provided for cutting the standard sized sheet into halves, thirds, quarters or sixths.

17 Claims, 2 Drawing Sheets

SANDPAPER CUTTING GUIDE

TECHNICAL FIELD

The invention relates to the measuring and cutting of abrasive sheet materials, such as sandpaper, and more particularly to an improved cutting guide to cut a standard sized sheet of sandpaper into pieces of a specified size and shape.

BACKGROUND ART

Hand held sanders come in many sizes and shapes and find widespread use among both professionals and amateur home craftsman. Both manual sanding blocks and portable electric sanders require sandpaper pieces smaller than the standard sheet size. Such sanders require frequent replacement of the abrasive surface as the abrasive material is quickly consumed during operation of the sander. Packages of precut replacement sandpaper sized to fit the particular tool are sometimes available, but such precut replacements tend to be relatively expensive. Moreover, maintaining several different stocks of precut paper (of perhaps several different degrees of abrasiveness or grit) for several different sanding devices is troublesome.

In order to save money, users will often cut or tear standard sized sheets of sandpaper into smaller pieces for use with their sanders. This can prove to be relatively time consuming, requiring careful measuring to obtain the most pieces from a sheet as well as to obtain the right size sheet for a particular application. An incorrect cut or tear may produce the correct size smaller piece for a certain application, but also produce a remaining portion of the sheet not suited to the production of further smaller sheet portions. That is, an inappropriate cut may result in generating increased scrap. It can also be wasteful, as when the sheet does not tear or cut as intended, with the result that the piece can not be used.

Cutting devices to assist the amateur craftsman in cutting replacement pieces of sandpaper have been suggested. Such devices usually take the form of paper cutters, ticket cutters and wallpaper cutters and are not designed specifically for cutting sandpaper. However, U.S. Pat. No. 3,991,992 to Martin and U.S. Design Pat. No. Des. 296,864 to Moulton et al both disclose abrasive sheet measuring and cutting boards with a permanently attached serrated edge for cutting sandpaper. These patented arrangements represent an improvement over the somewhat standard technique of laying the sandpaper sheet along the edge of a table top or other straight edged surface and simply tearing along that surface, but in either case, the tendency for paper to tear along a line other than that of the surface still results in the frequent generation of scrap pieces.

SUMMARY OF THE PREFERRED EMBODIMENT

The present invention is directed to a device for use by an average person to cut standard sized sheets of abrasive material to fit commercially marketed portable hand tools such as electric sanders, sanding blocks and the like. A preferred form of the invention includes a set of stacked rectangular members, each, except for the top one, containing one or more recesses sized to provide the abrasive material needed for various applications. When the members are assembled into a stack, the recesses form slots accessible from one side of the stack to receive sheets of abrasive surfaced material. Cutting guide slits extending through all except the bottom one of the stacked members and extending generally parallel to the stack side containing the slots are provided for guiding a cutting blade. These slits are aligned in the stacked members such that a cutting blade can simultaneously penetrate through each of the successive slit containing members. The recesses generally form three sides of rectangles with the slits perpendicular to two of those three sides.

To use the device, a standard sized sheet of abrasive material (typically nine inches by eleven inches) such as sandpaper is inserted into one of the slots. The cutting blade, such as a utility knife blade or razor blade, is inserted into one end of the cover guide (upper) slit, through the intermediate member slits, and into a guide groove in the bottom member. The cutting blade is them drawn along the length of the guide slit, evenly cutting off a piece of abrasive material from the sheet in the process. A further slot is provided to aid pushing the cut off piece from the slot.

If a smaller piece is needed, the process may be repeated using one of the smaller slots. By sequentially using the slots, a standard sized sheet of sandpaper can be quickly and accurately cut to provide, for example, any one of four standard sized sheets typically used with powered hand sanders. The sizing of the slots guides the user to produce correctly sized sheets without wastage.

In general then, and in one form of the invention, a sandpaper cutting guide has a relatively flat, generally rectangular body with a series of relatively thin generally rectangular pockets, each with an elongated narrow opening along an edge of the guide for receiving a sheet of sandpaper. A generally linear slit is formed in one face of the body for receiving and guiding a cutting edge. The slit extends along the body generally parallel to an edge of the body and into the body a distance sufficient to communicate with each of the pockets. A sheet of sandpaper may be inserted into one of the narrow openings and seated within a pocket, and a cutting edge may be inserted fully into the slit near one end thereof and drawn along the slit to the other end thereof thereby severing the sheet of sandpaper received within any one of the pockets. Preferably all of the narrow openings are along a common edge and there is at least one opening in the body face communicating with each pocket to allow access to a pocket for use by a user in retrieving the severed portion of the sheet from within the pocket. The portions of the pockets on the side of the slit opposite the common edge are each sized to generate a different sized sheet when severed so that a plurality of conventional smaller sized sheets may be efficiently cut from a standard sized sheet.

Accordingly, it is one object of this invention to provide an improved device for measuring and cutting standard sized sheets of abrasive material. A further object of the present invention is to reduce the amount of scrap abrasive material generated during the severing of standard sized sheets into smaller sheets for particular applications. These as well as other objects and advantageous features of the present invention will be in part apparent and in part pointed out hereinafter.

BRIEF DESCRIPTION OF THE DRAWING

Corresponding reference characters indicate corresponding parts throughout the several views of the drawing.

Figure 1:
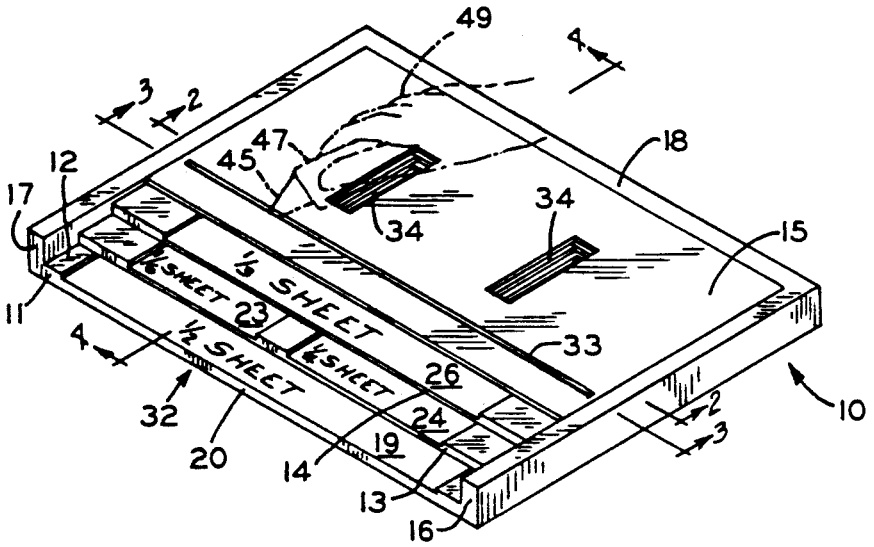
FIG. 1 is a perspective view of the present invention in one form.
Figure 2:
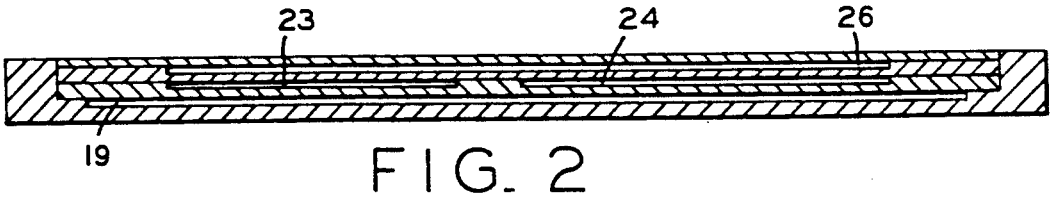
FIG. 2 is a view in cross-section along lines 2—2 of FIG. 1.
Figure 3:
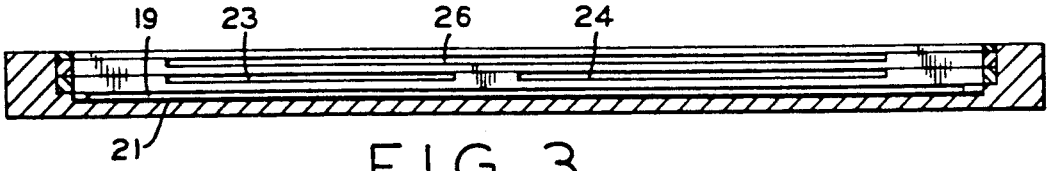
FIG. 3 is a view in cross-section along lines 3—3 of FIG. 1.
Figure 4:
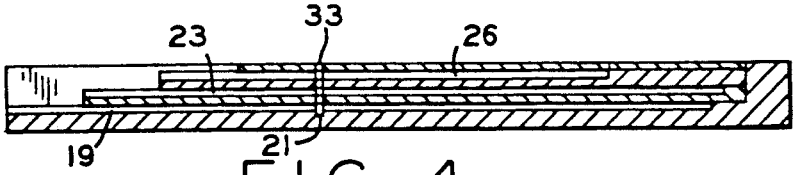
FIG. 4 is a view in cross-section along lines 4—4 of FIG. 1.

The exemplifications set out herein illustrate a preferred embodiment of the invention in one form thereof and such exemplifications are not to be construed as limiting the scope of the disclosure or the scope of the invention in any manner.

DETAILED DESCRIPTION OF THE PREFERRED EMBODIMENT

Referring to FIGS. 1-4 of the drawing, a sandpaper cutting guide 10 is shown in accordance with a preferred embodiment of the invention. The guide 10 is used to cut a standard nine by eleven inch sheet of sandpaper into halves, thirds, quarters or sixths. The resulting fractional sheets are the standard sizes of sandpaper used in hand tools such as many commercially available electric sanders. In the illustrated cutting guide 10, a base member 11 is provided with a recess 12 to hold a lower intermediate member 13, an upper intermediate member 14, and a cover member 15. The base member 11, the intermediate members 13 and 14, and the cover member 15 are preferably formed from a durable material such as injection molded plastic or aluminum. The intermediate members 13 and 14 and the cover member 15 are stacked and placed within the recess 12, which is formed by side edges 16 and 17 and a rear edge 18 of the base member 11.

Figure 5:
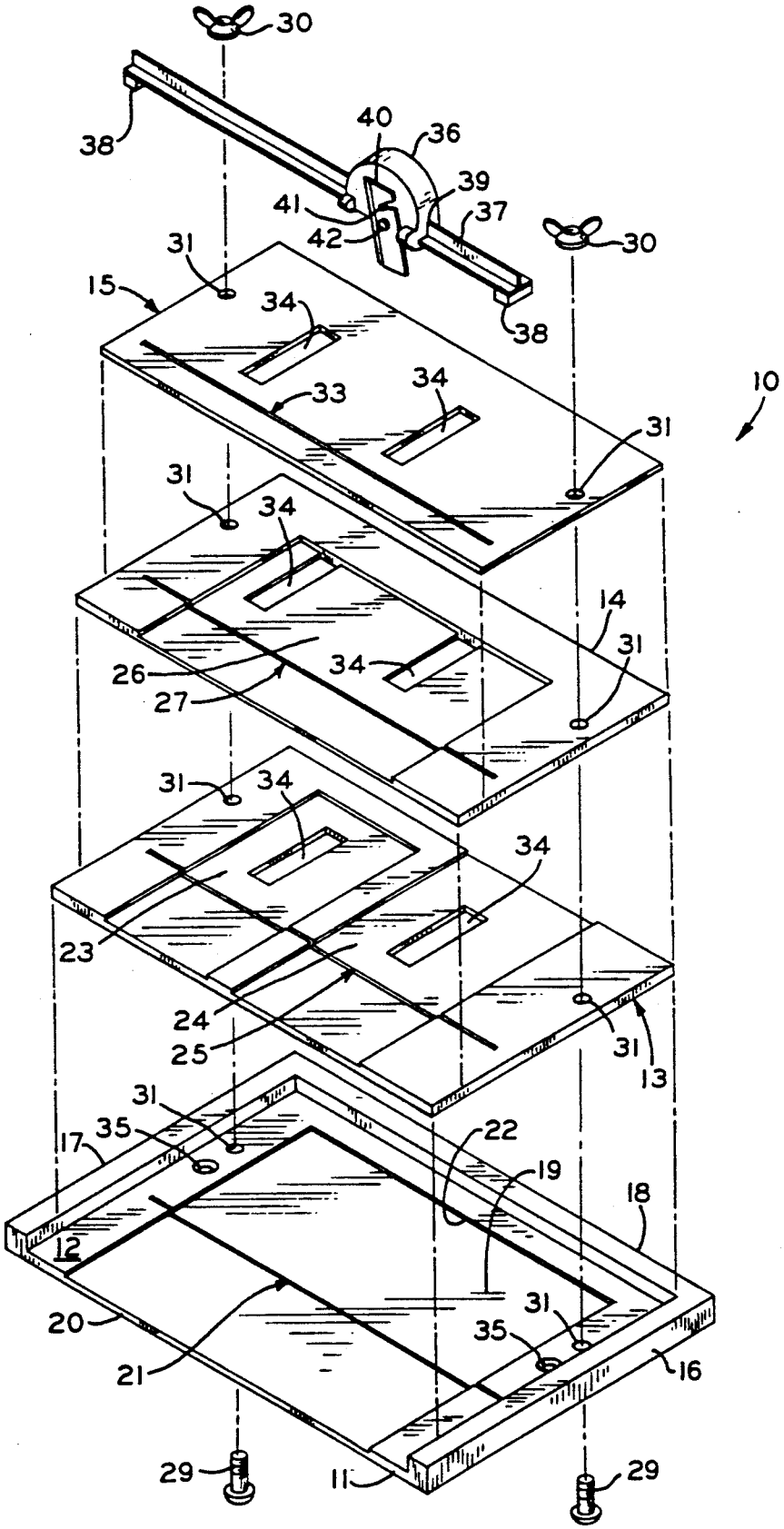
FIG. 5 is an exploded perspective view of an alternative form of the invention.

Within the recess 12, the base member 11 contains a recess 19 that is slightly wider than eleven inches to receive a standard nine by eleven inch piece of sandpaper when inserted sideways. A front edge 20 of the recess 19 is open to allow insertion of the sandpaper into the recess 19. The recess 19 is contiguous with this front edge 20. A groove 21 is provided in the base member 11 to guide the point or tip end of a cutting blade 45 of, for example, a standard utility knife 47. A razor blade or other cutting tool may, of course, be used. The groove 21 is parallel to and positioned four and one-half inches from a rear edge 22 (FIG. 5) of the recess 19. It will be noted that while FIG. 5 shows several possible modifications to the preferred embodiment of FIGS. 1-4, it also illustrates features of FIGS. 1-4 which are less readily seen in those figures. The groove 21 is longer than the width of the recess 19. Thus, the groove 21 extends beyond the sides of the recess 19 to allow positioning of the gutting blade without interference from a sheet of sandpaper and to insure that the entire length of the sheet is severed. When a standard sized piece of sandpaper is fully inserted sideways into the groove 21, the paper may be cut lengthwise into two halves, each sized four and one-half by eleven inches.

The lower intermediate member 13 has a left recess 23 and a right recess 24. There is also a slit 25 (FIG. 5) transversing the recesses 23 and 24 for guiding the cutting tool. The slit 25 extends beyond the outer edges of the recesses 23 and 24 to avoid interference from the sandpaper when the cutting tool blade 45 is initially positioned in the slit 25. The left recess 23 is dimensioned and located in relation to the guide slit 25 to permit a one-third sheet of sandpaper to be cut in half widthwise to produce two three and two-thirds by four and one-half inch sheets, each equal to one-sixth of a standard sheet of sandpaper. Similarly, the right recess 24 is dimensioned and positioned in relation to the guide slit 25 to permit a one-half sheet to be cut in half widthwise to produce two four and one-half by five and one-half inch quarter size sheets, each equal to one-fourth of a standard sheet. In order to have one continuous guide slit 25 for the lower intermediate member 13, the right recess 24 is longer (deeper in the direction away from the opening) than the left recess 23.

The upper intermediate member 14 contains a recess 26 that is slightly wider than nine inches to receive an end of a standard nine by eleven inch sheet of sandpaper. A slit 27 (FIG. 5) for guiding the cutting tool is located parallel to, and positioned three and two-thirds inches from, a rear edge 28 (FIG. 5) of the recess 26. The slit 27 is longer than the width of the recess 26 to allow initial positioning of the cutting tool blade 45 without interference from the sheet of sandpaper and to insure the cutting tool acts on the entire width of the paper. When the end of a standard sized piece of sandpaper is fully inserted into the recess 26 and a cutting tool is drawn along the slit, a three and two-thirds by nine inch piece will be cut off of the sheet. The newly cut piece is equivalent to one-third of a standard sheet. Inserting the remaining piece into the recess 26 and cutting again will produce two more like pieces each equal to one-third of the original sheet.

For convenience of description in both the specification and claims, the base 11, intermediate members 13 and 14 and the cover or upper member 15 have been described as separate pieces, but such language is intended to cover forming the body of the cutter as one integral piece, such as by injection molding. If formed as separate pieces, the intermediate members 13 and 14 and the cover or upper member 15 may be either riveted or staked to the base member 11, bonded thereto or otherwise formed integral therewith as shown in FIGS. 1-4, or they may be releasably assembled to the base member 11 with a pair of bolts 29 and wing nuts 30 as shown in FIG. 5. The bolts 29 pass through aligned holes 31 in base 11, intermediate members 13 and 14, and cover member 15. The holes 31 are offset from the recesses 19, 23, 24 and 26 to avoid interference with an inserted piece of sandpaper. While bonding or a bolt 29 and wing nut 30 are shown, other methods of fastening could be used equally well. One alternative would be to use hinges (not shown) to attach the intermediate members and the cover to the base member. By releasing the fasteners such as the wing nuts of FIG. 5, the guide may be opened to permit clearing or cleaning.

Upon assembly of the intermediate members 13 and 14, the cover member 15 and the base member 11, the recesses 19, 23, 24 and 26 open at a front 32 of the guide 10 for receipt of different sized pieces of sandpaper. To enhance access to the recesses, a stairstep configuration is employed. The lower intermediate member 13 is more narrow than the base member 11. Similarly, the upper intermediate member 14 is more narrow than the lower intermediate member 13, and the cover member 15 is more narrow that the upper intermediate member 14. The lower intermediate member 13 partially covers the recess 19 in the base member 11 to receive a side of a full size sheet of sandpaper. The cover member 15 partially covers the recess 26 in the upper intermediate member 14 to receive a side of an end of a full size sheet of sandpaper. Finally, the upper intermediate member 14 partially covers the recesses 23 and 24 in the lower intermediate member 13. The left recess 23 is sized to receive an end of a one-third size sheet of sandpaper while the right recess 24 is sized to receive the end of a one-half size sheet. The recesses position a sheet of sandpaper relative to the cutter preparatory to cutting. The unique recess widths provide a visual indication should the user attempt to use the wrong recess. Thus, the recesses guide the user to cut the paper to one of the available standard sizes.

A slit 33 is provided in the cover member 15 for the cutting tool blade 45. A pair of aligned slots 34 extend through the cover member 15 and the two intermediate members 13 and 14 allowing a user to easily push the cut sheets from the recesses 19, 23, 24 or 26 without dissembling the guide. If desired, the recesses can be labeled or embossed with size data to guide the user to the correct recess for an intended use.

In the preferred embodiment, the guide 10 is approximately ten inches deep, fifteen inches wide and one inch high. Thus, the guide is readily portable. A pair of countersunk holes 35 (FIG. 5) may be provided in the base member 11 for securing the guide to a workbench or other surface if desired. In its portable mode, one of the user's hands 49 holds the cutting tool while the other hand is used to hold the guide as well as to hold the sandpaper within the guide. While it is not necessary, securing the guide to a structure will free one of the user's hands to more positively hold the sandpaper in place within the guide.

To use the guide, a standard sized sheet of sandpaper is inserted into either recess 19 or recess 26. While not necessary, the paper may be somewhat easier to remove if the paper is inserted with the abrasive surface facing upwardly. The cutting blade 45 is inserted through one end of the aligned cover slit 33 and intermediate guide slits 25 and 27 to engage the guide groove 21 in the base 11. The cutting blade is then drawn along the slits 33, 25 and 27 while being kept in contact with the guide groove 21. It will be noted that the slits 25, 27 and 33 as well as the groove 21 extend somewhat beyond the standard eleven inch sandpaper sheet length to assure passage of the cutter through all layers for the full length of the sandpaper. This will cut the sheet in half if the sheet is positioned in the bottom recess 19 or cut off one-third of the sheet if it is in the top recess 26. The user then merely places a finger through one of the removal slots 34 and against the paper to push the cut sandpaper out of the guide 10. If a further reduction in size is needed, a second cut is made using the appropriate middle recess 23 or 24. A half sheet may be inserted into the right intermediate recess 24 and cut to yield two quarter sheets, or one-third of a sheet may be inserted into the left intermediate recess 23 and cut to yield two one-sixth sheets.

The exploded perspective view of FIG. 5 also illustrates an alternative form for the cutting blade. A cutter 36 is designed to slide along a T-shaped rail 37 mounted parallel to the cover guide slit 33. The rail 37 is supported at each end by an end block 38. The cutter includes a T-shaped opening 39 that is fitted to the rail 37. A knife blade 40 is secured to the cutter 36 by means of a protruding lug 41 and a screw 42 and extends through the slit 33. The blade 40 is easily removed when replacement is needed by simply removing screw 42. While lug 41 and screw 42 are shown, other means may be used to secure the blade 40 to the cutter 36. The cutter is moved along the rail 37 causing the blade 40 to cut a sheet of sandpaper in one of the recesses 19, 23, 24 or 26.

The cutting guide 10 has several advantages for cutting standard sized pieces of sandpaper. No measuring or folding of the sandpaper is required. Positioning of the sandpaper for cutting is easy and quick since the user merely inserts the sandpaper sheet fully into the appropriate recess. By inserting the paper into the recess that matches the sandpaper dimensions, a standard sized piece can be quickly cut. Finally, as the cutting tool blade dulls with usage, it is easily replaced with a new sharp one.

From the forgoing, it is now apparent that a novel guide for cutting standard sandpaper sheets into smaller pieces has been disclosed meeting the objects and advantageous features set out hereinbefore as well as others, and that numerous modifications as to the precise shapes, configurations and details may be made by those having ordinary skill in the art. The invention has been described with a particular order of the recesses from top to bottom however, the order may be rearranged. For example, the largest recess 19 may be formed in either of the intermediate members 13 or 14 instead of in the base member 11. In addition, the invention may be used in cutting sheets of other materials. The number and sizing of the recesses and the number of intermediate members may vary from the exemplary description given above. These as well as other modifications will be apparent to those skilled in the art and may be made without departing from the spirit of the invention or the scope thereof as set out by the claims which follow.

I claim:

1. An abrasive sheet cutting guide assembly comprising, a rectangular base member having a rectangular recess contiguous with a side of the base, said recess having a size for receiving at least a portion of a sheet of abrasive material, a cover attached to said base member to partially cover said recess, and said cover having a slit parallel to an inner edge of said recess for guiding a cutter while cutting said sheet.

2. An abrasive sheet cutting guide assembly as set forth in claim 1 further including a cutter, said base member including a groove parallel to and aligned with said slit, said groove guiding said cutter when said cutter is moved along said slit.

3. An abrasive sheet cutting guide assembly as set forth in claim 2 further comprising a rectangular intermediate member positioned between said base member and said cover, said intermediate member having at least one rectangular recess contiguous with a side of said cover for receiving a piece of abrasive material, said recess being oriented in the same direction as said recess in said base member, and said intermediate member having a slit parallel to and aligned with said cover slit and said base member groove for guiding said cutter parallel to an inner edge of said intermediate member recess.

4. An abrasive sheet cutting guide assembly as set forth in claim 1 further comprising a cutter and a plurality of rectangular intermediate members positioned between said base member and said cover, said intermediate members each having at least one rectangular recess each of which is contiguous with a side of the intermediate member for receiving a piece of abrasive material, said intermediate member recesses being oriented in the same direction as said recess in said base member, and said intermediate members each having a slit parallel to and aligned with said cover slit and said base member groove for guiding said cutter.

5. An abrasive sheet cutting guide assembly as set forth in claim 4 wherein different ones of said recesses are sized to receive different sizes of abrasive material.

6. An abrasive sheet cutting guide assembly as set forth in claim 5 wherein said cover and said intermediate members have aligned access slots to facilitate removing sheets after cutting.

7. An abrasive sheet cutting guide as set forth in claim 6 wherein said cover and said intermediate members are releasably attached to said base member.

8. An abrasive sheet cutting guide assembly as set forth in claim 6 wherein said cutter comprises the blade of a hand held knife.

9. An abrasive sheet cutting guide as set forth in claim 6 wherein said cutter comprises a knife blade secured to a blade holder, the blade holder being slidably attached to the cutting guide.

10. An abrasive sheet cutting assembly guide assembly as set forth in claim 9 wherein the knife blade is detachable from the blade holder.

11. An abrasive sheet cutting guide assembly as set forth in claim 9 wherein the cover includes a guide rail located adjacent to and parallel to said cover slit, said blade holder being slidably attached to said guide rail.

12. An abrasive sheet cutting guide assembly as set forth in claim 4 wherein said cover and said intermediate members have decreasing widths as taken in order of sequence from said base member to said cover.

13. An abrasive sheet cutting guide assembly as set forth in claim 1 wherein said cover has access slots to facilitate removing sheets after cutting.

14. A sandpaper cutting guide comprising, a relatively flat, generally rectangular body having a series of relatively thin generally rectangular pockets, each with an elongated narrow opening along an edge of the guide for receiving a sheet of sandpaper, a generally linear slit in one face of the body for receiving and guiding a cutting edge, the slit extending along the body generally parallel to an edge of the body and into the body a distance sufficient to communicate with each of the pockets, whereby a sheet of sandpaper may be inserted into one of the narrow openings and seated within a pocket, and a cutting edge may be inserted fully into the slit near one end thereof and drawn along the slit to the other end thereof thereby severing the sheet of sandpaper within any one of the pockets.

15. The sandpaper cutting guide of claim 14 wherein all said narrow openings are along a common edge.

16. The sandpaper cutting guide of claim 15 wherein the portions of the pockets on the side of the slit opposite the common edge are each sized to generate a different sized sheet when severed.

17. The sandpaper cutting guide of claim 14 further including at least one opening in said body face communicating with each pocket to allow access to a pocket for use by a user in retrieving the severed portion of the sheet from within the pocket.

* * * * *